United States Patent [19]

McMillan

[11] 4,311,898

[45] Jan. 19, 1982

[54] ELECTRIC BASEBOARD HEAT STORAGE APPARATUS AND METHOD OF CONVERSION

[76] Inventor: Charles G. McMillan, Rte. 9, Box 218, Mount Airy, N.C. 27030

[21] Appl. No.: 130,466

[22] Filed: Mar. 14, 1980

[51] Int. Cl.[3] ..... F24H 7/02; F24H 7/04

[52] U.S. Cl. ..... 219/378; 219/341; 219/365; 126/400; 165/55

[58] Field of Search ..... 219/378, 365, 341; 165/18, 55, 53; 237/75; 126/400

[56] References Cited

U.S. PATENT DOCUMENTS

| | | | |
|---|---|---|---|
| 2,858,781 | 11/1958 | Hexdall | 219/378 |
| 2,938,101 | 5/1960 | Borzner | 219/366 |
| 3,283,125 | 11/1966 | Swelling | 219/378 |
| 3,293,409 | 12/1966 | Swelling | 219/378 |
| 3,381,113 | 4/1968 | Jacques et al. | 219/378 |
| 3,785,365 | 1/1974 | Laing et al. | 219/378 |
| 3,884,295 | 5/1975 | Laing et al. | 219/378 |
| 3,989,927 | 11/1976 | Erb | 219/378 |
| 4,004,128 | 1/1977 | Marchesi | 219/346 |

FOREIGN PATENT DOCUMENTS

| | | | |
|---|---|---|---|
| 2803388 | 10/1978 | Fed. Rep. of Germany | 219/365 |
| 1029891 | 5/1966 | United Kingdom | 165/55 |
| 1337386 | 11/1973 | United Kingdom | 219/378 |

*Primary Examiner*—Gene Z. Rubinson
*Assistant Examiner*—Bernard Roskoski
*Attorney, Agent, or Firm*—B. B. Olive

[57] ABSTRACT

A heat storage apparatus for a conventional electrical baseboard-mounted heater requires no modification of the heater and provides means for supporting, storing heat within and circulating electrically-heated air through blocks of heat retaining material and an easy method of conversion to such form.

6 Claims, 6 Drawing Figures

ELECTRIC BASEBOARD HEAT STORAGE APPARATUS AND METHOD OF CONVERSION

BACKGROUND OF THE INVENTION

1. Field of the Invention:

The invention relates to electrical heaters of the baseboard type and particularly to heat storage means associated with such heaters and to methods of converting such heaters.

2. Description of the Prior Art:

Electrical baseboard heating units are widely employed as a source of heat for both residental and commercial applications. Such baseboard units are typically thermostatically controlled and typically have no means for storing heat. Thus, when the baseboard unit is off, the unit normally cools very rapidly and noticeable and undesirable temperature variations in the area being heated are often experienced. Accordingly, it would be desirable to provide heat storage means associated with the conventional electrical baseboard heater so as to smooth out the temperature fluctuations, provide a more uniform source of heat and have a source of heat that would operate even when the baseboard unit was electrically off.

U.S. Pat. No. 3,283,125 provides a type of baseboard heating unit with means to store some of the heat produced by the electrical heating unit. However, the approach taken in this patent requires modification to the interior structure of the baseboard heater and its effectiveness is limited by the space limitations within the heating unit. In this regard, it may be noted that a popular type of conventional baseboard heater is approximately six inches high, approximately three inches in depth and varies in length from two to eight feet or even longer. A substantial portion of the space within the conventional baseboard heater unit is occupied by the resistance type heating element which normally extends throughout the length of the heater unit. Thus, space limitations preclude provision of heat storage means within the baseboard heater unit itself when larger than such space.

Other attempts at providing heat storage associated with electrical heaters are illustrated in U.S. Pat. Nos. 3,381,113, 3,989,927 and 4,004,128. However, so far as applicant is aware, there has not been available an apparatus which could simply be associated with a conventional electrical baseboard heater unit without requiring any modification of the conventional baseboard unit construction and yet provide substantial heat storage.

With the foregoing in mind, the principal object of the present invention is to provide an apparatus which can be used with the conventional electrical baseboard heater without requiring that it be modified and so as to provide substantial heat storage and thereby obtain a more uniform type of heating as well as a reduction in the amount of electrical energy necessary to maintain a comfortable level of heat within the area being heated by the baseboard unit. Other objects will become apparent as the description proceeds, both as to the apparatus as well as the method.

SUMMARY OF THE INVENTION

An apparatus for storing heat provided by an electrical baseboard heater unit comprises a housing which is positioned immediately above the baseboard heater unit and within the housing a frame for supporting heat retaining material. An air diverter associated with the housing guides the heated air from the baseboard heater unit upward through a stack of heat-retaining bricks which are mounted on the frame within the housing. When the heater unit is on, hot air flows from the baseboard unit, through the stack of bricks and out the top of the housing so as to heat the area in which the baseboard unit is installed. When the baseboard heater unit is off, hot air continues to flow utilizing heat stored in the bricks. Consequently, a longer period of more uniform heat is maintained and which serves to reduce the amount of electricity necessary to heat the area in which the baseboard unit is installed during its continuous cyclic operation.

In a preferred form of the invention, means are provided for an electrically-operated blower to come on when the baseboard heater unit is off so as to increase the amount of heat extracted from the heat stored in the bricks. In a simpler form of the invention, the blower arrangement is not employed and the heated air leaving the housing in which the bricks are stored is allowed to rise naturally upward through holes provided in the bricks.

DESCRIPTION OF THE PREFERRED EMBODIMENT

Figure 1:
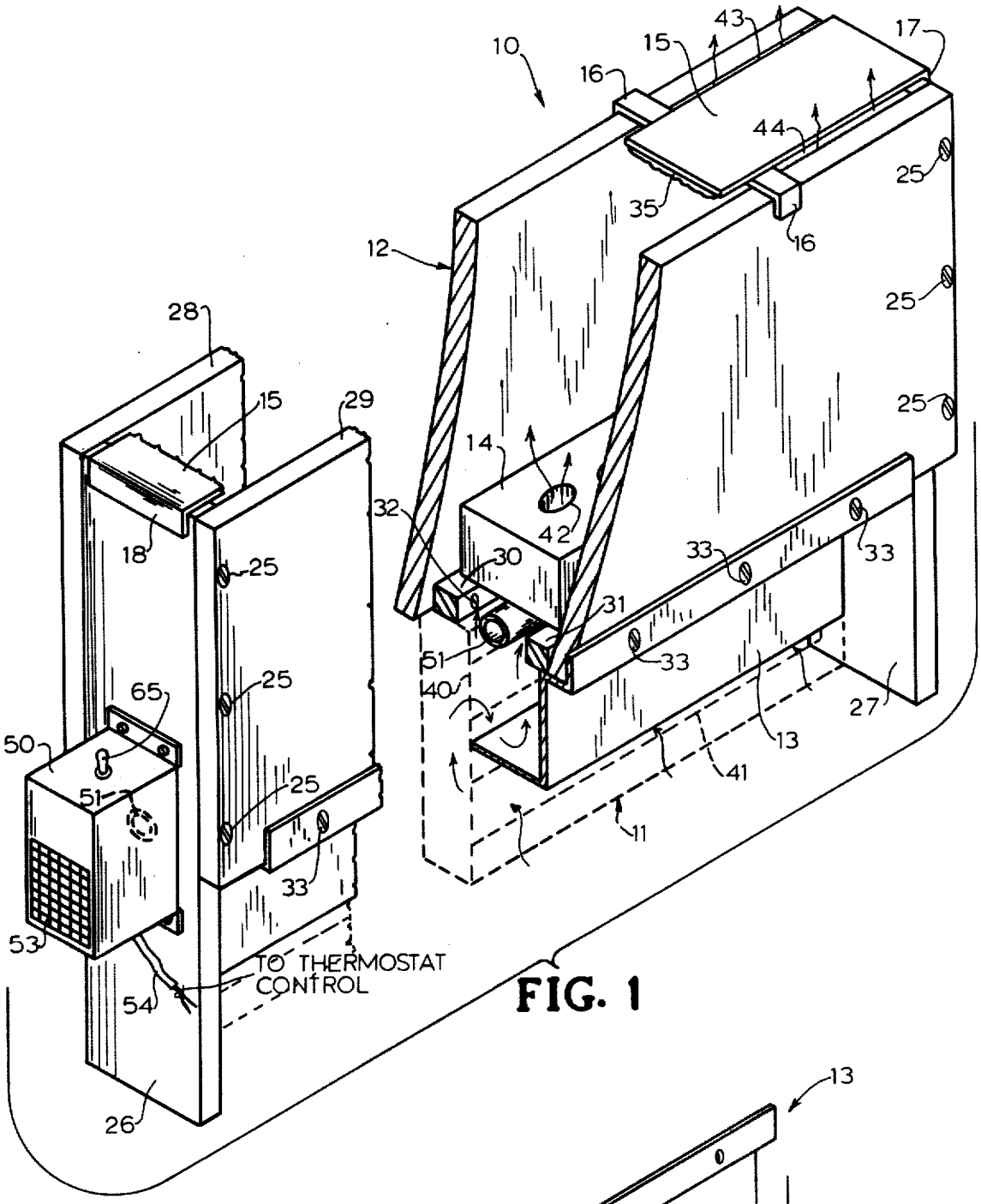
FIG. 1 is a fragmentary perspective view of the heat storage apparatus of the invention installed on a conventional baseboard heater unit which is generally illustrated in dashed lines.
Figure 3:
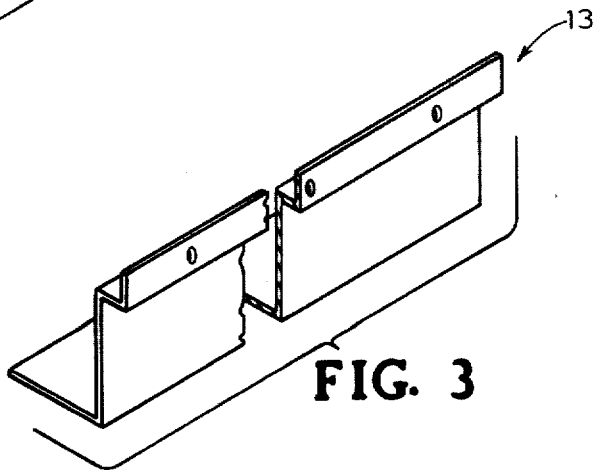
FIG. 3 is a fragmentary perspective view of an air diverter used to divert hot air from the baseboard unit into the apparatus of the invention.

Referring to the drawings, the heat storage apparatus 10 of the invention is designed to be used in cooperation with a conventional electrical baseboard heater unit 11 which is normally mounted along the wall against the baseboard. The heat storage apparatus 10 includes an elongated housing 12 of substantially the same length as the length of the baseboard heater unit 11, a hot air diverter 13, heat retaining material 14, illustrated as bricks, and an insulated cover 15 whose use is preferred but optional.

Housing 12 has open top and bottom ends and is made up of a pair of end wall-leg members 26, 27 to which are secured a back wall 28 and a front wall 29 utilizing screws 25 or other appropriate fastening means to establish an open ended vertical hollow housing.

A pair of support strips 30, 31 are secured internally and adjacent the bottom edges of the respective back and front walls 28, 29 utilizing screws 32 or other suitable fastening means and serve as a means for supporting the heat retaining material 14 illustrated as bricks. A wide range of materials are available from which the end wall, back wall and front wall members may be made. While sheet metal is acceptable as illustrated, it is desirable that housing 12 be made up of a material having a heat insulating characteristic. A metal-foam laminate or fire resistant treated sheet, for example, would be considered suitable materials for this purpose so as to maximize the temperature of the air which exits the top of housing 12 during use of the apparatus of the invention. Internally insulation sprayed metal sheet could also be used.

In order to efficiently divert the electrically heated hot air produced by the baseboard heater unit 11, a hot air diverter 13 formed of sheet metal is secured by means of screws 33 along one edge to front wall 29 and resides between the end wall-leg members 26, 27. Room air is thus allowed to follow its normal path by entering the baseboard heater unit 11 through the conventional cool air opening 41, be electrically heated while flowing through the baseboard heater unit 11 and then be allowed to discharge from baseboard heater unit 11 through the hot air exit opening 40 typically provided at the top and along the length of the baseboard heater unit 11. The hot air diverter 13 then operates to direct the electrically heated hot air upwardly through the housing 12 and through the heat retaining material 14.

Figure 2:
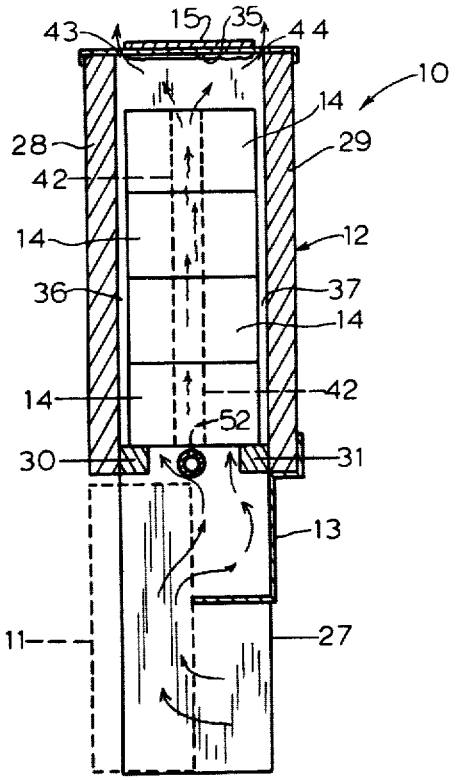
FIG. 2 is a vertical section view through the heat storage apparatus of the invention.
Figure 4:
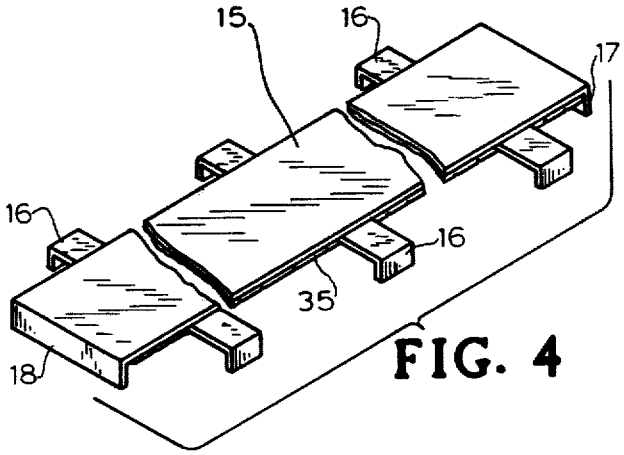
FIG. 4 is a fragmentary perspective view of a removable cover employed with the housing of the invention.
Figure 5:
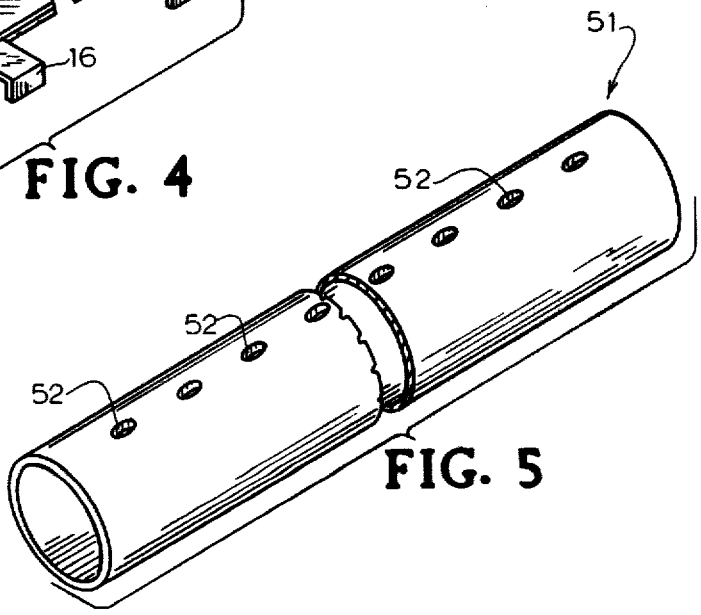
FIG. 5 is an enlarged fragmentary perspective view of a blower tube employed with the apparatus of the invention.

The heat retaining material 14 in the preferred embodiment takes the form of bricks made of clay, olivine or similar heat retaining material. Bricks 14 are preferably of the type having holes 42 and typically have a plurality of such holes along the length of the brick. The first layer of bricks 14 are placed on the support members 30, 31 and lays lengthwise thereon so that the holes 42 in the bricks 14 are aligned and provide a path for the heated air deflected upwardly by the diverter 13 to pass through the bricks 14 before exiting out of the top of the housing 12. When baseboard heater unit 11 is four feet in length, a housing 12 was provided with the end wall-leg members 26, 27 spaced fifty inches apart. In this configuration, six bricks were placed lengthwise with approximately one-quarter inch clearance on each end so as to provide an air path around the ends of the bricks and also so as to prevent direct contact between the bricks 14 and the inner wall surfaces of the end wall-leg members 26, 27. In this same configuration, the bricks 14 were stacked four high within housing 12 as best illustrated in FIG. 2. Thus, a total of twenty-four bricks were provided for heat storage purposes. Once the bricks 14 had been stacked as illustrated in the drawings, the top open end of housing 12 was partially covered by means of cover 15 with the cover supports 16 resting on the back and front walls 28, 29 and with the downwardly turned flanges 17, 18 engaging the top edges of the end wall-leg members 26, 27. A heat insulating material 35 is secured to the bottom surface of cover 15 so as to minimize the heat transmitted through cover 15 and the spaces 36, 37 are also provided to prevent direct side contact between the stack of bricks 14 and the interior wall surfaces of the respective front and back walls 28, 29. From the drawings and the description, it will be seen then that a natural air path is provided allowing the heated air to flow directly upward through the holes 42 in the bricks 14 and to exit along the edges of the cover 15 through openings 43, 44 at the top of housing 12.

The heat storage apparatus 10 of the invention is provided with means to establish forced circulation of the heated air through the heated bricks 14. For this purpose, there is provided an electrically operated blower 50 and blower tube 51. Blower tube 51 is provided with a series of holes 52 along the length of its upper outer wall surface and is closed at one end adjacent the end wall-leg member 27. At the opposite end, tube 51 passes through end wall-leg member 26 and connects to blower 50 having a small squirrel cage fan, not shown. When blower 50 is operating, room air is drawn through a suitable grilled opening 53, through blower 50 and is forced out of tube 51 through holes 52 from which the air is allowed to rise upwardly through the holes 42 in the bricks 14.

Figure 6:
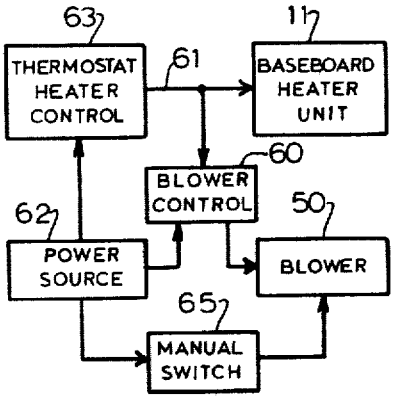
FIG. 6 is a schematic diagram of a control system associated with the blower of the invention.

Blower 50 may be provided with a normally closed relay illustrated as the blower control 60 in FIG. 6 and which is tied to the line 61 through which electric power flows from the power source 62 subject to the thermostat heater control 63. Thus, with the wiring configuration illustrated in FIG. 6, blower 50 is caused to come on and be energized whenever baseboard heater unit 11 is off. Alternatively, the blower 50 is off whenever the baseboard heater unit 11 is on. In order to be able to bypass the thermostat control 63, a normally off manual switch 65 is also provided which enables a direct connection to be made between the power source 62 and the blower 50. Thus, with either arrangement, stored heat can be extracted from bricks 14 with a forced draft flow at all times when the baseboard heater unit 11 is off or, if desired, blower 50 can be operated subject to manual control. In a still further configuration, with manual switch 65 off, the blower control 60 could be in the form of a normally open relay so that blower 50 is energized each time baseboard heater unit 11 comes on. However, this mode of operation would provide a less uniform temperature in the area being heated. In a still further mode, the heat storage apparatus 10 of the invention may be employed utilizing natural air circulation only and without any use of forced air circulation such as provided by blower 50. This last mentioned mode of operation, i.e., without forced air circulation, would still provide substantial advantage in minimizing temperature fluctuations and also in reducing the overall heating cost by providing a natural flow of hot air at all times when the baseboard heater unit 11 was off, e.g., during periods when high rates prevail.

In summary, it is seen that the present invention does provide heat storage apparatus which can be easily installed on the conventional electrical baseboard heater unit with no modification being required. Furthermore, the apparatus of the invention also insures that a more uniform heating will be obtained, temperature fluctuations will be less using the apparatus of the invention and a more economical and energy efficient operation will be provided in the long term. While use of cover 15 is preferred, the apparatus 10 nevertheless offers an improved heat storage device whether cover 15 is or is not employed. Also, since cover 15 is easily removed, its use can be dictated by weather conditions. As previously mentioned and in accordance with the drawing, it is desirable that the mass of heat retentive material, i.e., bricks 14, have surrounding air spaces on each end, on both sides and on the top side of the brick stack. Such air spaces provide a degree of heat insulation and insure that the walls of the housing 12 absorb a minimum amount of heat. Rock wool, foam or spray-on insulation could be employed to fill such air spaces, if desired, so long as the desired and necessary air passages through the mass of heat retentive material were not blocked. In all such forms of the invention, it will nevertheless be appreciated that the conventional baseboard heater unit can be employed with no modification but with substantially improved overall operation. An easy method of conversion is thus provided.

Also to be recognized is that while in the specific embodiment illustrated the baseboard unit itself is relieved from supporting any of the added weight associated with the heat retentive material, i.e., the bricks 14, such weight could in many cases be supported by the baseboard unit itself. For example, when the baseboard unit housing is made of structurally strong sheet metal and is soundly secured to a baseboard which, in turn, is soundly secured to the building studs, the invention recognizes that the unit itself is quite capable of supporting substantial additional weight on the top of the unit with no harm. Thus, for this type of installation, the end wall-leg members 26, 27 could be appropriately shortened and the weight of the bricks 14 could actually be supported on the baseboard heater unit itself or an appropriate short-legged, floor-supported rack overlying the conventional heater could be provided to support the weight of the brick. Further, it is contemplated that the brick could be glued or banded together as a unit sprayed with a decorative heat insulating coating and the hot air diverter 13 secured directly to the brick by appropriate securing devices such as masonry screws, or the like. The invention thus provides the conventional electric baseboard heater with an improved heat storage character and also provides an easy method of converting the conventional electric baseboard heater to achieve such improved heat storage.

What is claimed is:

1. An electrical heating apparatus comprising:

(a) an electrical baseboard heating unit having an elongated enclosure mounted against the base of a vertical wall, an electrical resistance heater within and extending the length of the enclosure, said enclosure having top and bottom openings extending along the front and for the length of the enclosure allowing a continuous flow of cool air to circulate into said bottom opening, past said resistance heater to collect and store heat transferred therefrom and to exit out of the said top opening of said enclosure as heated air;

(b) a temperature regulated control connected to and providing continuous cyclical operation of said baseboard unit;

(c) an auxiliary structure supported against the wall on which said baseboard unit is mounted, immediately above and overlying said baseboard heating unit and having wall members forming above said baseboard unit and for the length thereof a vertical, hollow housing having open top and bottom ends and being adapted to receive and provide a vertical channel for heated air rising from said baseboard unit enclosure top opening;

(d) air diverter means formed and mounted on the front of and in association with said auxiliary structure and baseboard unit in a manner enabling substantially all of the heated air exiting the top opening of said baseboard heating unit enclosure to be directed into the open bottom end of said hollow housing; and (e) a mass of heat retentive material supported within and occupying a major portion of the space within said hollow housing and having associated vertically oriented air passages arranged such that air heated by said resistance heater and exiting said baseboard heating unit enclosure top opening is allowed to rise upwardly into the open bottom end of said housing, through said air passages, contact at least portions of said heat retentive material and thereby heat such heat retentive material and thereafter be discharged through the said top end of said hollow housing such that when said resistance heater is off, heat stored in said heat retentive material may be employed as a supplemental source of heat for air flowing through said hollow housing.

2. An electrical heating apparatus as claimed in claim 1 wherein said heat retentive material comprises a plurality of bricks formed of a heat retentive material, loosely stored in said hollow housing and containing holes extending through the thickness of the bricks and vertically aligned to provide at least in part said air passages.

3. An electrical heating apparatus as claimed in claim 1 including a cover partially covering said top end of said housing.

4. An electrical heating apparatus as claimed in claim 1 including an electrically operated blower, control means therefor, and associated tubular means mounted in operative association with said housing enabling said blower when operative to establish a forced draft of air through said heat retentive material.

5. An electrical heating apparatus as claimed in claim 1 wherein said wall members are arranged to structurally support the weight of said heat retentive material on a floor surface such that said baseboard heating unit enclosure and the wall on which it is mounted is relieved of such weight.

6. An electrical heating apparatus as claimed in claim 1 including means establishing a heat insulating barrier surrounding the ends and sides of said mass of heat retentive material.

* * * * *